US005500105A

United States Patent [19]

Leenhouts et al.

[11] Patent Number: 5,500,105

[45] Date of Patent: Mar. 19, 1996

[54] BOWED SHAPE ELECTROFORMS

[75] Inventors: Timothy J. Leenhouts, Fairport; Gary J. Maier, Webster, both of N.Y.

[73] Assignee: Xerox Corporation, Stamford, Conn.

[21] Appl. No.: 347,936

[22] Filed: Dec. 1, 1994

[51] Int. Cl.[6] ..... C25D 1/00

[52] U.S. Cl. ..... 205/67; 205/73

[58] Field of Search ..... 205/67, 68, 69, 205/70, 71, 72, 73, 74, 75, 76, 77, 78, 79

[56] References Cited

U.S. PATENT DOCUMENTS

| | | | |
|---|---|---|---|
| 3,763,030 | 10/1973 | Zimmer | 204/281 |
| 3,905,400 | 9/1975 | Dupree | 138/140 |
| 3,947,348 | 3/1976 | Schabernack | 205/73 |
| 3,984,183 | 10/1976 | Maksymiak | 355/16 |
| 4,177,113 | 12/1979 | Seibt | 205/76 |
| 4,501,646 | 2/1985 | Herbert | 205/73 |
| 4,902,386 | 2/1990 | Herbert | 205/50 |

*Primary Examiner*—John Niebling
*Assistant Examiner*—Brendan Mee
*Attorney, Agent, or Firm*—T. L. Fair

[57] ABSTRACT

An electroforming process and apparatus for bowing the imaging surface to provide "steering" for moving the electroformed imaging surfaces over rollers or like devices. One embodiment of the present invention is to bow or crown the electroformed imaging surface by using a bimetallic mandrel. The outer material of the mandrel has a greater coefficient of expansion than the inner material. Thus, when the mandrel is heated the outer material expands more than the inner material creating the bowed or crown effect. The electroform takes on the bowed shape during plating and maintains that shape when removed from the mandrel. Another embodiment of the present invention involves mechanically or hydraulically bowing the mandrel and then plating the electroform on the bowed surface. This electroform also maintains the bowed shape when removed from the mandrel.

3 Claims, 2 Drawing Sheets

BOWED SHAPE ELECTROFORMS

BACKGROUND OF THE INVENTION

This invention relates generally to an electroforming process, and more particularly concerns a process for creating a bowed electroform.

The fabrication of hollow metal articles by an electroforming process is well known. For example, hollow metal articles are fabricated by electro-depositing a metal onto an elongated mandrel which is suspended in an electrolytic bath. The resulting seamless electroformed tubes are thereafter removed from the mandrel by sliding the tube off one end of the mandrel. Different techniques have been developed for forming and removing tubes from electroforming mandrels depending upon the cross-sectional area of the electroformed tube. Examples of these techniques are described in U.S. Pat. No. 3,844,906 to R. E. Bailey et al. and U.S. Pat. No. 4,501,646 to W. G. Herbert.

One use of these seamless electroformed tubes is as an imaging surface (i.e. photoreceptor or photoconductor) in an electrostatographic printer or copier. However, a deficiency of these electroformed imaging surfaces are the "steering" problems that can occur as the imaging surface rotates about roller(s) or like cylindrical device. One method of "steering" the imaging surface involves the use of stops (e.g. rubber material) along the edges of the imaging surface as the imaging surface rotates. These rubber stops act as a guide for the imaging surface, causing the imaging surface to align itself by bumping into the rubber stops during rotation. Unfortunately, the bumping action between the stops and the imaging surface to keep the imaging surface in place can cause motion quality problems and image defects.

The following disclosures may be relevant to various aspects of the present invention and may be briefly summarized as follows:

U.S. Pat. No. 3,984,183 to Maksymiak discloses the self-stripping action of a copy sheet from an imaging surface after transfer in electrostatographic copying is substantially increased by slightly curving the imaging surface transverse their mutual direction of movement to provide a slight corresponding crown in the copy sheet on the imaging surface at the stripping area where the imaging surface is curved away from the path of the copy sheet in their direction of movement. Examples of the imaging surface are a substantially cylindrical photoreceptor surface with a uniform slight continuous crown, or a flexible belt slightly deformed over a crowned support roller.

SUMMARY OF INVENTION

Briefly stated, and in accordance with one aspect of the present invention, there is provided the method of forming a curved electroform. The method comprises: forming a substantially convex surface along a longitudinal axis of the mandrel; plating the convex surface of the mandrel with a material to form the curved electroform; cooling the curved electroform and the mandrel; and separating the curved electroform from the mandrel.

BRIEF DESCRIPTION OF THE DRAWINGS

Other features of the present invention will become apparent as the following description proceeds and upon reference to the drawings, in which.

Figure 1A:
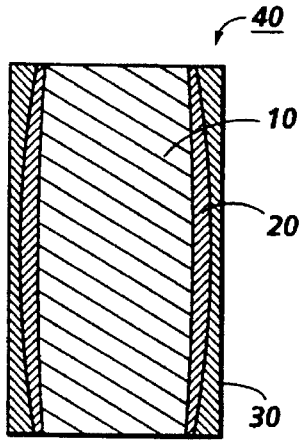
FIG. 1A shows a schematic sectional elevational view of a bimetallic mandrel of the present invention in a contracted state.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of an electroforming process in which the present invention may be incorporated, reference is made to U.S. Pat. No. 4,501,646 which describes a conventional electroforming process using a core mandrel and U.S. Pat. No. 4,902,386 which describes an electroforming mandrel and method of fabricating and using same. The contents of these patents are herein incorporated by reference.

Reference is now made to the drawings where the showings are for the purpose of illustrating a preferred embodiment of the invention and not for limiting same.

In both embodiments of the present invention discussed herein, the mandrel is made from materials whose expansion and contraction are greater than that of the electroformed material so that the electroform will contract to a greater extent than the mandrel to allow "parting" to occur so that the electroform can be removed. Any suitable metal capable of being deposited by electroforming and having a coefficient of expansion of between about $6\times10^{-6}$ in/in/° F. and about $10\times10^{-6}$ in/in/° F. may be used in the embodiments of the present invention. Preferably, the electroformed metal has a ductility of at least about 8 percent elongation. Typical metals that may be electroformed include: nickel; copper; cobalt; iron; gold; silver; platinum; lead and the like and alloys thereof.

Any suitable mandrel core may be utilized to fabricate the mandrel of this invention. The core mandrel may be solid and of large mass or hollow with means to heat or maintain the heat of the interior to prevent cooling of the mandrel while the deposited coating is cooled. Thus, the mandrel core preferably has high heat capacity, for example, in the range from about 3 to about 4 times the specific heat of the electroformed article material. This determines the relative amount of heat energy contained in the electroformed article compared to that in the core mandrel. Also, as well known in the art, at least the outer surface of the mandrel core should be electrically conductive. Further, the core mandrel preferably exhibits high thermal conductivity to maximize the difference in temperature (Delta T) between the electroformed article and the core mandrel during rapid cooling of the electroformed article to prevent any significant cooling and contraction of the core mandrel. In addition, a large difference in temperature between the temperature of the cooling bath and the temperature of the coating and mandrel core maximizes the permanent deformation due to the stress-strain hysteresis effect. A high thermal coefficient of expansion is also desirable in a core mandrel to optimize permanent deformation due to the stress-strain hysteresis effect. Typical mandrel cores include aluminum, mild steel, stainless steel, titanium, titanium palladium alloys, and the like, which have suitable structural integrity.

Generally, the electroformed hollow articles of the present invention have relatively thin sleeves. For example, the sleeves may range in thickness from about 0.0005 inch (0.013 mm) to about 0.020 inch (0.05 mm). Normally thicker sleeve walls are desirable for electroformed hollow articles having relatively large perimeters of more than 7.5 centimeters where flexibility is not a required characteristic.

Figure 1B:
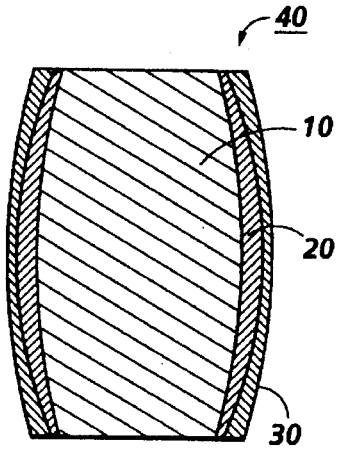
FIG. 1B shows a schematic sectional elevational view of the bimetallic mandrel of the present invention in an expanded state.

Reference is now made to FIGS. 1A and 1B, which show a schematic elevational view of a bimetallic mandrel which is an embodiment of the present invention. FIG. 1A shows the contracted state (i.e. before heating or after cooling) of the mandrel and FIG. 1B shows the expanded state (i.e. during heating) of the mandrel.

Currently metal electroforms are fabricated using straight sided (e.g. non-curved) male or female mandrels which produce straight sided electroform cylinders. With continued reference to FIGS. 1A and 1B, the bimetallic mandrel 40 of the present invention comprises at least two metallic materials 20, 30 on a mandrel core 10 having different thermal coefficients of expansion. The different metallic materials 20, 30 are layered adjacent to each other to form a bimetallic mandrel 40. The bimetallic mandrel 40 thermally deforms into a bowed shape (see FIG. 1B) by heating the bimetallic mandrel 40 to plating temperatures (for example for a nickel electroform, the nickel plating temperature is approximately 140° F.±1° F. for an electrolytic sulfamic acid bath), thus, allowing the plated electroform to be shaped into a bowed cylinder. The outer mandrel material 30 of the bimetallic mandrel 40 has a greater coefficient of expansion than the inner mandrel material 20. (Examples of inner mandrel materials and their approximate respective thermal coefficients of expansion include: steel, $8.4\times10^{-6}$in/in/° F.; copper, $9.2\times10^{-6}$in/in/° F.; and nickel, $7.2\times10^{-6}$in/in/° F. An example of an outer mandrel material is aluminum having a thermal coefficient of expansion of about $13\times10^{-6}$in/in/° F.) This difference in coefficients of expansion creates the bowing effect desired on the bimetallic mandrel 40 because the inner material 20 rate of expansion is not as great as the rate of expansion for the outer material 30 when the mandrel is heated (i.e. the inner mandrel material 20 expands less then the outer material 30). It is noted that the thickness ratio of the inner and outer materials used for the bimetallic mandrel 40 can be varied to accommodate the bow desired. However, the maximum bow should not exceed the elastic limit of the electroform material (i.e. so that cracking does not occur). The mandrel could be shaped with a varying cross-sectional area to allow varied strain over length.

Figure 1C:
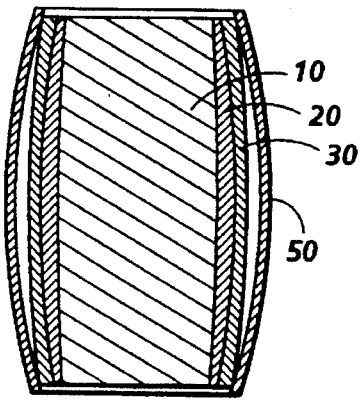
FIG. 1C shows a schematic sectional elevational view of a bimetallic mandrel of the present invention during "parting" of an electroform from the outer surface of the mandrel.

Current is then applied to the bowed (e.g. curved or arcuate) shape of the mandrel to plate the mandrel from the electroform. When the electroform plating is complete, the mandrel and electroform are cooled. The cooling step, for example, a cool water bath (40° F.), contracts the mandrel at a greater rate than the electroform so that the electroform can be removed from the mandrel. The separation of the electroform 50 from the mandrel 40 is called "parting" (see FIG. 1C). As the mandrel cools, the mandrel returns to its initial unbowed form shown in FIG. 1A. However, the electroform maintains the bowed shape upon cooling. This bowed shape of the electroformed imaging surface provides steering since the uneven nature (i.e. curvature) of imparted stresses creates a steering force. These electroforms could then be used as they are made or coated with materials, to enhance the coefficient of friction between the drive part (i.e. rollers) and the driven part (i.e. electroformed photoreceptor).

Figure 2A:
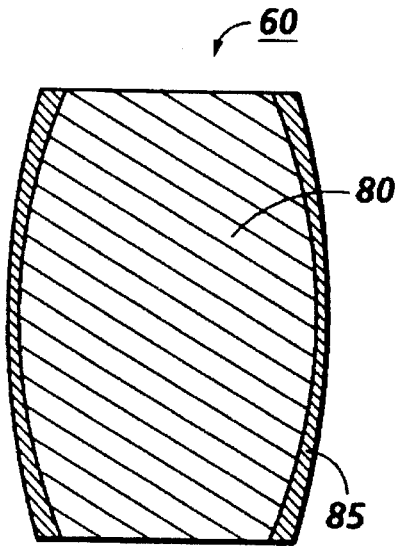
FIG. 2A shows a schematic sectional elevational view of another embodiment of the present invention where the mandrel is permanently bowed.
Figure 2B:
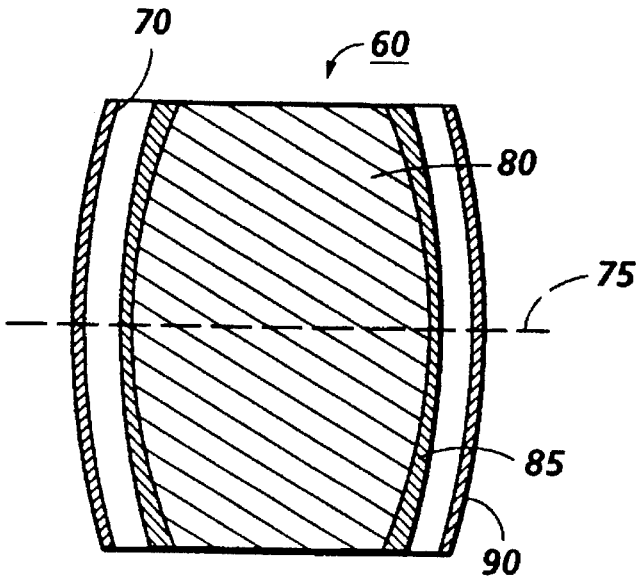
FIG. 2B shows a schematic sectional elevational view of "parting" of an electroform from the mandrel of FIG. 2A.

Reference is now made to FIG. 2A, which shows another embodiment of the present invention in which the mandrel is permanently bowed. The straight sided male or female mandrels which produce straight sided cylinders are mechanically or hydraulically (e.g. using a lathe) deformed into a bowed shape. This mandrel 60 is heated to expand, although it is already in a bowed shape, because upon cooling, the bowed mandrel 60 must contract more than the electroform 90 for "parting" to occur (see FIG. 2B). Then, as described above, a plated electroform is fabricated into a bowed cylinder shape using this heated mandrel 60. As the mandrel cools, there must be sufficient space between the mandrel and the electroform, as they contract away from each other, to allow the smaller diameter of the electroform on the ends 70 to slide over the bowed middle section 75 of the contracted mandrel upon removal of the electroform 90 from the mandrel 80 (see FIG. 2B). This spacing requirement between the electroform and the mandrel for removal of the electroform therefrom, is done by using the difference in thermal coefficient of expansions between the bowed mandrel 60 and the electroform 80. For example, a core mandrel made of nickel with a thermal coefficient of expansion of $7.2\times10^{-6}$ in/in/° F. plated with an aluminum electroform with a thermal coefficient of expansion of $13\times10^{-6}$ in/in/° F. has a sufficient difference in thermal coefficients of expansion to allow the aluminum electroform fit over the bowed middled section of the nickel mandrel. This is useful in that many applications are in existence where rollers or drive units are machined into this shape to provide steering for the belts that ride on them since the uneven nature of imparted stresses creates a steering force. These electroforms could then be used as they are made or coated with materials 85 to enhance the coefficient of friction between the drive part and the driven part.

Some advantages of the present invention include that it is less expensive to bow or crown the electroform than to crown the roller as described in U.S. Pat. No. 3,984,183 because all the rollers would have to be bowed to provide the steering feature of the present invention. Also, the present invention simplifies the number of components needed. Once the electroform is created using the present invention, the electroform is already bowed so no other components are needed to bow the electroform as required when the roller(s) upon which the electroform rides during rotation requires.

Additionally, the steering provided by bowing the electroform decreases the contamination due to edge grinding from the substrate, that occurs, from the edge guide, in prior methods designed to assist steering of the electroform.

In recapitulation, the present invention discloses bowing or curving of the electroformed imaging surface to provide steering for moving the electroformed imaging surfaces. One embodiment of the present invention is to bow or crown the electroformed imaging surface by using a bimetallic mandrel. The outer material of the mandrel has a greater coefficient of expansion than the inner material. Thus, when the mandrel is heated the outer material expands more than the inner material creating the bowed or crown effect. The electroform takes on the bowed shape during plating and maintains that shape when removed from the mandrel by cooling. Another embodiment of the present invention involves mechanically or hydraulically bowing the mandrel and then plating the electroform on the bowed surface. This electroform also maintains the bowed shape when removed from the mandrel.

It is therefore apparent, that there has been provided in accordance with the present invention, a bowed electroform that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. A method of forming a curved electroform, comprising:

forming a substantially convex surface along a longitudinal axis of a mandrel by applying a first layer of material having a first thermal coefficient of expansion on the mandrel, applying a second layer of material having a second thermal coefficient of expansion on the first layer, the second thermal coefficient of expansion being greater than the first thermal coefficient of expansion and heating the mandrel to expand the first layer and the second layer of the mandrel, differing amounts creating the convex surface;

plating the convex surface of the mandrel with a material to form the curved electroform; and separating the curved electroform from the mandrel.

2. The method recited in claim 1, wherein the separating step comprises:

cooling the electroform and the mandrel defining a space therebetween; and removing the electroform from the mandrel.

3. The method recited in claim 2, wherein the removing step comprises sliding the electroform along the longitudinal axis of the mandrel to separate the electroform therefrom.

* * * * *